US009562314B2

(12) United States Patent
Kim et al.

(10) Patent No.: US 9,562,314 B2
(45) Date of Patent: Feb. 7, 2017

(54) LAUNDRY TREATING APPARATUS

(71) Applicant: LG Electronics Inc., Seoul (KR)

(72) Inventors: Seongkyu Kim, Gyeongnam (KR); Juhan Yoon, Gyeongnam (KR); Soonjo Lee, Gyeongnam (KR); Soowon Park, Gyeongnam (KR); Jongho Kim, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 500 days.

(21) Appl. No.: 14/078,785

(22) Filed: Nov. 13, 2013

(65) Prior Publication Data

US 2014/0237841 A1 Aug. 28, 2014

Related U.S. Application Data

(60) Provisional application No. 61/769,756, filed on Feb. 27, 2013.

(51) Int. Cl.

| | |
|---|---|
| ***F26B 21/06*** | (2006.01) |
| ***D06F 58/20*** | (2006.01) |
| ***D06F 58/02*** | (2006.01) |

(52) U.S. Cl.

CPC ..... *D06F 58/20* (2013.01); *D06F 58/02* (2013.01)

(58) Field of Classification Search

CPC ..... D06F 2058/2858; D06F 2058/2854; D06F 2058/2859; H01H 9/043; H01H 9/042; F16K 1/16; F16K 1/18

USPC ..... 34/491, 558, 492, 493, 497, 544, 566; 169/49, 20; 454/194, 232, 369; 137/527.4, 137/527, 527.2, 527.8; 251/301, 303; 126/287.5, 504, 536, 285 R, 293

See application file for complete search history.

(56) References Cited

U.S. PATENT DOCUMENTS

| | | | |
|---|---|---|---|
| 4,262,430 | A | 4/1981 | Janson |
| 6,189,228 | B1 | 2/2001 | Schuette |
| 7,367,206 | B2 | 5/2008 | Asada |
| 2004/0065125 | A1 | 4/2004 | Asada |
| 2005/0235519 | A1 | 10/2005 | Chung |

FOREIGN PATENT DOCUMENTS

| | | | |
|---|---|---|---|
| CN | 1453417 | A | 11/2003 |
| CN | 1497094 | A | 5/2004 |
| CN | 101029450 | A | 9/2007 |
| DE | 102010031268 | A1 | 1/2012 |
| DE | 102011082861 | B3 | 1/2013 |
| GB | 335028 | A | 9/1930 |
| JP | S 60-063198 | A | 4/1985 |

(Continued)

OTHER PUBLICATIONS

Chinese Office Action dated Sep. 6, 2015, for Chinese Application No. 201310641529.7, with English translation, 16 pages.

(Continued)

*Primary Examiner* — Kenneth Rinehart
*Assistant Examiner* — John McCormack
(74) *Attorney, Agent, or Firm* — Fish & Richardson P.C.

(57) ABSTRACT

A laundry treating apparatus includes a cabinet forming an external appearance of the laundry treating apparatus, an accommodation space provided in the cabinet to receive laundry, and a discharge portion allowing an interior of the accommodation space to communicate with an exterior of the cabinet and adapted to discharge air in the accommodation space from the cabinet. The laundry treating apparatus also includes a supply portion that supplies air into the accommodation space, and a shutoff portion adapted to open and close the discharge portion.

21 Claims, 9 Drawing Sheets

(56) References Cited

FOREIGN PATENT DOCUMENTS

| | | | |
|---|---|---|---|
| JP | S 62-151898 | A | 7/1987 |
| JP | 01-262895 | A | 10/1989 |
| JP | 2002-081858 | A | 3/2002 |
| JP | 2004-121644 | A | 4/2004 |
| JP | 2013-000442 | A | 1/2013 |

OTHER PUBLICATIONS

European Search Report dated Jul. 4, 2014 for Application No. 14150083.5, 5 pages.

(a)

(b)

(a)

(b)

(a)

(b)

(a)

(b)

LAUNDRY TREATING APPARATUS

This application claims the benefit of U.S. Patent Application No. 61/769,756, filed on Feb. 27, 2013, which is hereby incorporated by reference as if fully set forth herein.

FIELD

The present disclosure relates to a laundry treating apparatus.

BACKGROUND

A laundry treating apparatus is an appliance to perform washing, drying, or both washing and drying. Examples of laundry treating apparatus include washing machines, dryers, and washing and drying machines.

Laundry treating apparatuses capable of drying clothing supply high-temperature air (hot air) to the clothing. These laundry treating apparatuses can be classified into an exhaust type and a circulation (or condensation) type depending on how the air flow is created.

The circulation type laundry treating apparatus removes moisture from the air discharged from the accommodation space containing the laundry (dehumidifies the air), heats the air, and then re-supplies the air to the accommodation space. The exhaust type laundry treating apparatus supplies heated air to the accommodation space, but discharges the air discharged from the accommodation space from the laundry treating apparatus instead of re-supplying the discharged air to the accommodation space.

In the case of a conventional laundry treating apparatus, fire breaks out (for a variety of reasons) in the laundry contained in the accommodation space, flames in the accommodation space may escape the laundry treating apparatus and spread to the room where the laundry treating apparatus is installed.

When the laundry surrounded by flames stays in the accommodation space for a long time, flammable gas produced during burning of the laundry may cause explosion. When explosion occurs in the accommodation space, flames in the accommodation space may be discharged from the laundry treating apparatus by the pressure of the explosion.

SUMMARY

In one aspect, a laundry treating apparatus includes a cabinet, an accommodation space provided in the cabinet and configured to receive laundry, and a discharge portion allowing an interior of the accommodation space to communicate with an exterior of the cabinet and adapted to discharge air in the accommodation space from the cabinet. The laundry treating apparatus also includes a supply portion that supplies air into the accommodation space based on the air in the accommodation space being discharged through the discharge portion and a shutoff portion positioned in the cabinet and adapted to open and close the discharge portion.

Implementations may include one or more of the following features. For example, in a closed configuration, the shutoff portion may prevent the air in the accommodation space from being discharged from the cabinet through the discharge portion and may allow air in the cabinet, but outside of the accommodation space, to discharge from the cabinet through the discharge portion. In addition, the shutoff portion may allow the discharge portion to communicate with an interior of the cabinet that is outside of the accommodation space based on the shutoff being arranged in a closed configuration in which the discharge portion is closed.

In some implementations, the discharge portion may include a connection duct that allows the air in the accommodation space to be discharged therethrough, and an exhaust duct that guides air introduced into the connection duct to the exterior of the cabinet. In these implementations, the shutoff portion may include an exhaust duct penetrating hole provided to the exhaust duct to allow an interior of the exhaust duct to communicate with an interior of the cabinet and a penetrating hole flap provided to the exhaust duct and configured to open one of the exhaust duct penetrating hole and the exhaust duct. Further, in these implementations, the discharge portion may include an exhaust fan configured to introduce the air in the accommodation space into the connection duct and the penetrating hole flap may close the exhaust duct penetrating hole based on the exhaust fan operating, and closes the exhaust duct based on operation of the exhaust fan having stopped.

In some examples, the laundry treating apparatus may include a pressure reduction portion positioned in the cabinet and configured to discharge the air in the accommodation space from the accommodation space to the cabinet based on a pressure in the accommodation space becoming equal to or higher than a predetermined reference pressure. In these examples, the pressure reduction portion may include an opening and closing device provided to at least one of the accommodation space and the supply portion and configured to open and allow the air in the accommodation space to flow into the cabinet based on the pressure in the accommodation space becoming equal to or higher than a predetermined reference pressure.

In some implementations, the supply portion may include a heating duct configured to heat the air in the cabinet and a supply duct configured to guide air discharged from the heating duct to the accommodation space and the opening and closing device may include a supply duct exhaust hole provided to penetrate the supply duct and allow an interior of the supply duct to communicate with the interior of the cabinet and a supply duct flap provided to the supply duct and configured to close the supply duct exhaust hole. In these implementations, the supply duct flap may be rotatably provided to the supply duct and may be configured to close the supply duct exhaust hole based on a self-weight of the supply duct flap. Also, in these implementations, the cabinet may include an introduction port communicating with the accommodation space and a door provided to open and close the introduction port and a pressure in the accommodation space needed to overcome the self-weight of the supply duct flap and open the supply duct flap may be less than a pressure in the accommodation space needed to overcome a force by which the door is fastened to the cabinet and open the door.

Further, the laundry treating apparatus may include a rear support provided in the cabinet and supporting a rear surface of the accommodation space. The rear support may be provided with a supply portion communication hole connected to the supply duct. The supply duct may include a duct body extending from the heating duct toward the supply portion communication hole along a direction of a height of the cabinet, and an inclined surface to connect the duct body with the supply portion communication hole. The inclined surface may be arranged to be inclined toward a bottom surface of the cabinet and the opening and closing device may be provided on the inclined surface.

In some examples, the laundry treating apparatus may include a front support provided in the cabinet and supporting a front surface of the accommodation space. In these examples, the front support may be provided with a discharge portion communication hole that allows the air in the accommodation space to be discharged to the discharge portion. Also, in these examples, the laundry treating apparatus may include a rear support provided in the cabinet and supporting a rear surface of the accommodation space. The rear support may be provided with a supply portion communication hole connected to the supply portion and the opening and closing device may be provided to at least one of the front support and the rear support.

In some implementations, the pressure reduction portion may include a discharge portion opening/closing device provided to the discharge portion and configured to open and allow the air in the accommodation space to flow into the cabinet based on the pressure in the accommodation space becoming equal to or higher than the reference pressure. In these implementations, the discharge portion may include a connection duct that allows the air in the accommodation space to be discharged therethrough, an exhaust fan configured to move the air in the accommodation space into the connection duct, and an exhaust duct configured to discharge air introduced into the connection duct from the cabinet. The discharge portion opening/closing device may be provided to the connection duct.

In some examples, the discharge portion opening/closing device may include a connection duct exhaust hole that allows an interior of the connection duct to communicate with an interior of the cabinet therethrough and a connection duct flap configured to open and close the connection duct exhaust hole. In these examples, the connection duct exhaust hole may be positioned between an introduction port of the connection duct and the exhaust fan and the connection duct flap may be rotatably provided to the connection duct and may be configured to close the connection duct exhaust hole based on a self-weight of the connection duct flap.

In some implementations, the connection duct exhaust hole may be positioned between an introduction port of the connection duct and the exhaust fan. In these implementations, the connection duct flap may include a body configured to open and close the connection duct exhaust hole, a body support provided to the connection duct and spaced a predetermined distance from the body, and a guider adapted to penetrate the body and extend from the body support toward the connection duct exhaust hole.

In another aspect, a laundry treating apparatus includes a cabinet, an accommodation space provided in the cabinet and configured to receive laundry, and a cabinet flow channel allowing an interior of the cabinet to communicate with an exterior of the cabinet therethrough. The laundry treating apparatus also includes an accommodation space flow channel that connects the accommodation space, a discharge flow channel that guides air in the accommodation space to the exterior of the cabinet, and a supply flow channel that guides air into the accommodation space. The laundry treating apparatus further includes a fan provided to the accommodation space flow channel and configured to discharge the air in the accommodation space from the cabinet and a shutoff portion that is configured to allow flow of air between the cabinet flow channel and the supply flow channel based on the fan operating and that is configured to, based on operation of the fan having stopped, prevent the flow of air between the supply flow channel and the cabinet flow channel while allowing flow of air between the discharge flow channel and the cabinet flow channel.

Implementations may include one or more of the following features. For example, the shutoff portion may be provided in a down stream portion of the accommodation space flow channel at a location guiding air having passed through the fan toward the exterior of the cabinet. In this example, the laundry treating apparatus may include a pressure reduction portion provided in an upper stream portion of the accommodation space flow channel at a location guiding air to the fan. The pressure reduction portion may be configured to discharge the air in the accommodation space into the cabinet based on a pressure in the accommodation space becoming equal to or higher than a predetermined reference pressure.

In some implementations, the cabinet may include an introduction port communicating with the accommodation space and a door provided to the cabinet and configured to open and close the introduction port and the pressure reduction portion may allow the accommodation space flow channel to communicate with the interior of the cabinet based on a pressure in the accommodation space that is less than a pressure in the accommodation space needed to overcome a force by which the door is fastened to the cabinet and open the door. In these implementations, the cabinet flow channel may be defined by a cabinet flow inlet provided to penetrate the cabinet and the cabinet flow inlet may not overlap a projection of the pressure reduction portion onto the cabinet such that air discharged from the pressure reduction portion does not discharge from the cabinet through the cabinet flow inlet.

It is to be understood that both the foregoing general description and the following detailed description are exemplary and explanatory and are intended to provide further explanation of the subject matter claimed.

DETAILED DESCRIPTION

Figure 1:
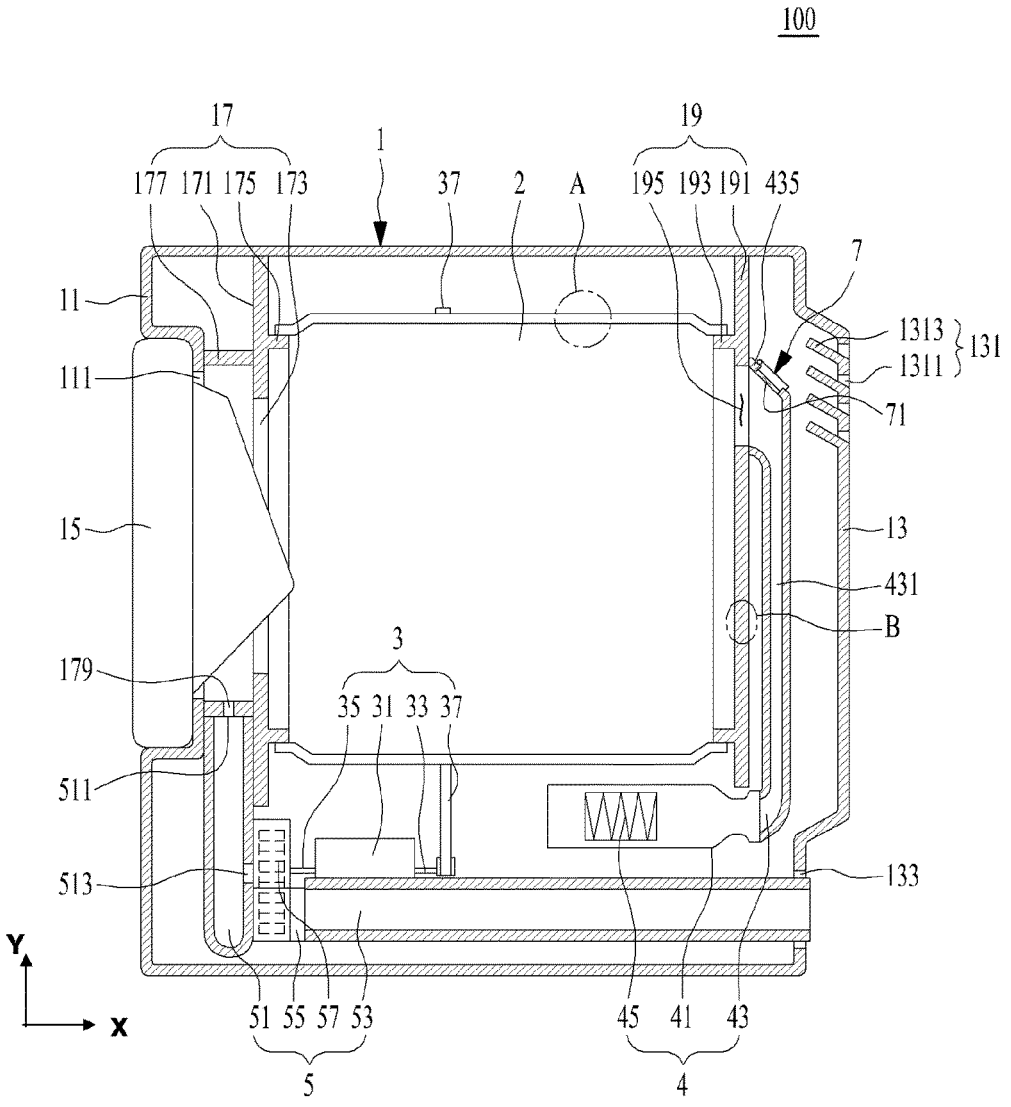
FIG. 1 is a view illustrating an example laundry treating apparatus.

FIG. 1 illustrates an example laundry treating apparatus 100. The laundry treating apparatus 100 includes a cabinet 1 defining an external appearance of the laundry treating apparatus, an accommodation space provided in the cabinet 1 to accommodate laundry, a supply portion 4 to supply air to the accommodation space, and a discharge portion 5 to discharge air in the accommodation space from the cabinet 1.

The cabinet 1 may include a front panel 11 provided with an introduction port 111 for introduction and retrieval of laundry, and a rear panel 13 provided with a cabinet inlet port 131 allowing the interior of the cabinet 1 to communicate with the exterior of the cabinet 1.

The front panel 11 is provided with a door 15 to open and close the introduction port 111. Accordingly, a user may introduce the laundry into or retrieve the same from the accommodation space through the door 15 and the introduction port 111.

The rear panel 13 is arranged to face the front panel 11 of the cabinet 1 provided with the door 15. The cabinet inlet port 131 allows air outside of the cabinet 1 to flow into the cabinet.

That is, the cabinet inlet port 131 is a flow channel (e.g., a cabinet flow channel) allowing air outside of the cabinet to flow into the cabinet therethrough.

The cabinet inlet port 131 may be provided with a plurality of panel through holes 1311 formed to penetrate the rear panel 13 in the width direction of the cabinet 1 (the direction of Z axis), and a flange 1313 extending from the lower surface of each of the panel through holes toward the interior of the cabinet 1 to be inclined.

The flanges 1313 reduce (e.g., prevent) water outside of the cabinet 1 from flowing into the cabinet 1 through the panel through holes 1311. Accordingly, when the indoor space where the laundry treating apparatus 100 is installed is cleaned, it may be possible to minimize introduction of water into the cabinet 1.

In addition, the rear panel 13 may be further provided with a cabinet discharge port 133 to discharge air moving through the discharge portion 5 from the cabinet 1.

In the case that the laundry treating apparatus 100 is only intended to dry the laundry, the accommodation space may be provided with a drum 2 rotatably arranged in the cabinet 1.

The drum 2 may be formed in a cylindrical shape having an open front and open back. In this case, the cabinet 1 may be further provided therein with a front support 17 and a rear support 19 which support the drum 2 such that the drum 2 is rotatable.

The front support 17 may be provided with a support body 171 fixed to the interior of the cabinet 1, a body through hole 173 provided to penetrate the support body 171, and a front flange 175 provided to the support body 171 to support the front of the drum 2.

The body through hole 173 is arranged to communicate with the introduction port 111, and accordingly the laundry introduced through the introduction port 111 may be moved into the drum 2 through the body through hole 173.

The support body 171 may be provided with a guide duct 177 having a cylindrical shape and extending toward the door 15. In this case, the guide duct 177 may be arranged to connect the front panel 11 to the support body 171 to surround the circumferential surface of the body through hole 173 and the circumferential surface of the introduction port 111.

The front flange 175 may be formed to protrude from the surface of the support body 171 toward the drum 2, along the circumferential surface of the body through hole 173. The inner circumferential surface of the front of the drum 2 is rotatably supported by the outer circumferential surface of the front flange 175.

The front support 17 is further provided with a discharge portion connection hole 179 coupled to the discharge portion 5, which will be described in more detail later. The discharge portion connection hole 179 is arranged to penetrate the guide duct 177. The discharge portion connection hole 179 allows the interior of the drum 2 to communicate with the exterior of the drum 2 therethrough.

The rear support 19 may be provided with a support body 191 fixed to the interior of the cabinet 1, and a rear flange 193 provided to the support body 191 to support the back of the drum 2 such that the drum 2 is rotatable.

The rear support 19 is further provided with a supply portion connection hole 195 coupled to the supply portion 4, which will be described in more detail later. The supply portion connection hole 195 is formed to penetrate the support body 191. The supply portion connection hole 195 allows the interior of the drum 2 to communicate with the exterior of the drum 2.

In the case that the laundry treating apparatus 100 is formed to perform drying and washing the laundry, the accommodation space may be provided with a tub arranged in the cabinet 1 to contain washing water, and a drum 2 rotatably coupled to the interior of the tub.

In this case, the front support and the rear support may be omitted. In addition, the body through hole 173, the guide duct 177 and the discharge portion connection hole 179 are provided to the front of the tub, which is cylindrically shaped. The supply portion connection hole 195 may be provided to the outer circumferential surface of the tub, and the drum 2 may be rotatably supported in the tub by a rotating shaft that penetrates the back of the tub. In addition, the circumferential surface of the drum may be provided with a plurality of through holes allowing the tub to communicate with the interior of the drum therethrough.

Hereinafter, a description will be given of the laundry treating apparatus 100 which only functions to dry laundry, as an example. Other examples may include other types of laundry treating apparatus.

The drum 2 is rotated by a drive unit 3. As shown, the drive unit 3 may include a drum motor 31 provided in the cabinet 1, a first rotating shaft 33 and a second rotating shaft 35, which are rotated by the drum motor 31, and a belt 37 to connect the circumferential surface of the drum 2 to the first rotating shaft 33.

The second rotating shaft 35 is connected to an exhaust fan 57 through a fan housing 55 provided to the discharge portion 5. Accordingly, in the illustrated example, the drum 2 and the exhaust fan 57 may be rotated at the same time using one drum motor 31.

The supply portion 4 is a supply flow channel through which air (e.g., hot air or unheated air) is supplied to the drum 2. Accordingly, the supply portion 4 may be composed of a supply duct 43 through which air is supplied to the drum 2.

In this case, the supply duct 43 may be arranged to supply air in the cabinet 1 to the drum 2, or to supply air outside of the cabinet 1 to the drum 2.

In the case that the supply portion 4 is provided to supply heated air (e.g., hot air) to the drum 2, the supply portion 4 may include a heating duct 41 provided with a heater 45 to heat air and a supply duct 43 to guide the air discharged from the heating duct 41 to the drum 2.

In this case, the heating duct 41 may be formed in the shape of a column having open opposite sides facing each other and positioned in the cabinet 1. In addition, the supply duct 43 may include a duct body 431 to connect the heating duct 41 with the supply portion connection hole 195.

In the case that the heating duct 41 is arranged in a space between the drum 2 and the bottom surface of the cabinet 1 or in a space between the lateral surface of the drum 2 and the cabinet 1, the duct body 431 may extend from the heating duct 41 along the height of the cabinet 1 (e.g., the height of the drum 2).

Further, the duct body 431 coupled to the supply portion connection hole 195 may be provided with a mount surface 435 (inclined surface) parallel with or inclined toward the bottom surface of the cabinet 1.

The discharge portion 5 is a discharge flow channel through which air in the drum 2 is discharged from the cabinet 1 (a discharge flow channel through which air in the drum 2 is discharged to an outside of the cabinet 1). Accordingly, the discharge portion 5 may include a connection duct 51 through which the air in the drum 2 is discharged, and an exhaust duct 53 to guide the air introduced into the connection duct 51 to the outside of the cabinet 1.

The connection duct 51 and the exhaust duct 53 are connected to each other through the fan housing 55. The fan housing 55 is provided with an exhaust fan 57 to move the air in the drum 2 into the connection duct 51.

The connection duct 51 includes a duct inlet port 511 and a duct discharge port 513. The duct inlet port 511 is coupled to the discharge portion connection hole 179 provided in the front support 17.

The fan housing 55 provides a space in which the exhaust fan 57 is rotatable and connects the duct discharge port 513 to the exhaust duct 53.

Accordingly, when the exhaust fan 57 is rotated in the fan housing 55 by the second rotating shaft 35 provided to the drum motor 31, the air in the drum 2 may be introduced into the connection duct 51 through the discharge portion connection hole 179 and the duct inlet port 511, and the air in the connection duct 51 may be moved to the exhaust duct 53 through the duct discharge port 513 and the fan housing 55.

Once the air in the drum 2 is discharged from the cabinet by the exhaust fan 57, the pressure in the drum 2 is lowered, and therefore the air in the cabinet 1 may be moved into the drum 2 through the supply portion 4.

With this configuration, external air may be continuously supplied into the cabinet 1 through the cabinet flow channel, which is formed by the cabinet inlet port 131, and when the heater 45 operates during movement of air into the drum 2 through the supply portion 4, the laundry treating apparatus 100 may supply hot air to the drum 2.

That is, in the illustrated example, the drum 2, the discharge flow channels 51 and 53, and the supply flow channels 41 and 43 are connected to each other to form a single flow channel (one flow channel unit). Accordingly, when the air in the drum 2 is discharged from the cabinet 1 through the exhaust fan 57, air flow is created between the flow channel unit and the cabinet flow channel, and thus air may be continuously supplied to the drum 2. Therefore, the laundry treating apparatus according to the illustrated example does not supply air to the drum 2 unless the exhaust fan 57 operates.

In some circumstances, the laundry treating apparatus 100 configured as above may encounter the following problems when fire breaks out in the laundry stored in the drum 2.

In the case that fire breaks out in the laundry in the drum 2 (the cause of which is not clear), flames in the drum 2 may be discharged from the cabinet 1, and thereby the room where the laundry treating apparatus 100 is installed may catch fire.

In the case that the laundry burns in the drum 2 for a long time, flammable gas produced during burning of the laundry may cause flash over, or backdraft may occur when more than a certain amount of air is suddenly supplied into the drum 2. Accordingly, when explosion occurs in the drum 2, the door may be opened by the pressure of the explosion and thereby the flames in the drum 2 may be discharged from the cabinet 1.

Therefore, in some implementations, the laundry treating apparatus 100 further includes at least one of a shutoff portion 9 (FIG. 7) to prevent explosion by blocking supply of air to the drum 2 (naturally extinguishing flames), and a pressure reduction portion 7 to prevent discharge of flames from the drum 2 to the outside of the cabinet 1 due to pressure produced when explosion occurs in the drum 2.

Hereinafter, a description will be given of the pressure reduction portion 7 and then of a shutoff portion 9.

In the case that explosion occurs in the drum 2, the pressure reduction portion 7 discharges the air in the drum 2 not from the cabinet 1 but into the cabinet 1 such that flames are prevented from being discharged from the cabinet 1.

When explosion (e.g., flash over or backdraft) occurs in the drum 2, the pressure in the drum 2 drastically increases. When pressure increases in the drum 2, a member to seal the drum 2 (such as the door 15) with relatively weak force is damaged or opened, and thereby flames in the drum 2 may be discharged from the cabinet 1.

Accordingly, the pressure reduction portion 7 is provided to prevent the flames from being discharged from the cabinet 1 due to explosion by discharging the air in the drum 2 into the cabinet 1 (by decreasing the pressure in the drum) in the case that explosion occurs in the drum 2 in spite of presence of the shutoff portion 9.

To this end, the pressure reduction portion 7 may be provided in the upper stream of the flow channel unit, which guides air to the exhaust fan 57, to discharge the air in the drum 2 into the cabinet 1 when pressure in the drum 2 is equal to or higher than a predetermined reference pressure.

Figure 2:
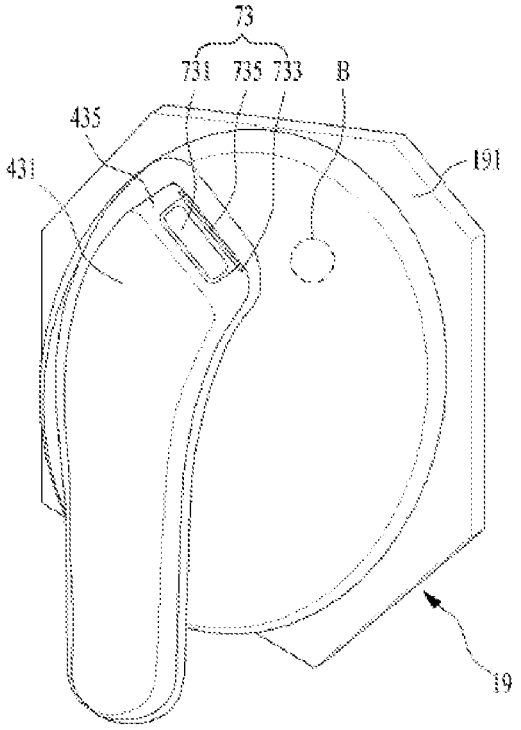
FIG. 2 is a view illustrating an example pressure reduction portion (e.g., an example supply portion opening/closing device)
Figure 2:
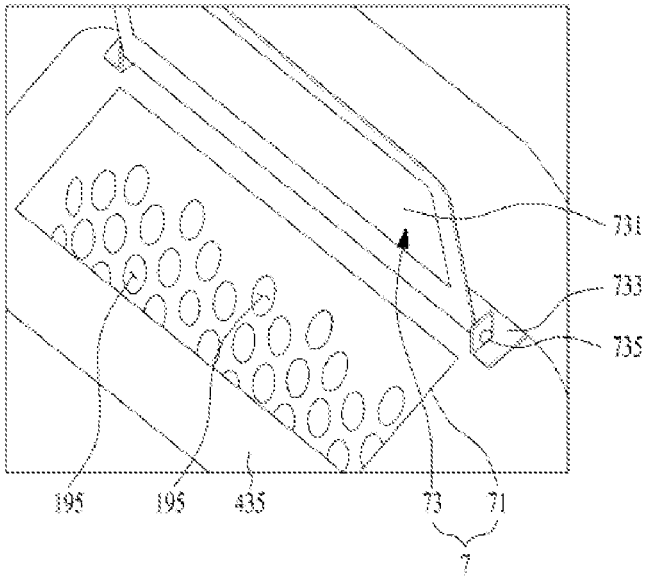

More specifically, referring to FIGS. 1 and 2, the pressure reduction portion 7 may be provided with an opening/closing device 71 and 73 (a supply portion opening/closing device) provided to the supply portion 4 to move the air in the drum 2 into the cabinet 1 when the pressure in the drum 2 is equal to or higher than a predetermined reference pressure.

The reference pressure may be set to a pressure in the drum expected to be produced when explosion occurs in the drum 2 (an experimental value). The reference pressure may be set to (or slightly lower than) a pressure which releases fastening between the door 15 and the cabinet 1 (e.g., a pressure capable of forcing the door open).

The reference pressure may be set to a pressure which overcomes the force by which the door 15 is fastened to the cabinet 1. This is because the door 15, among the structures allowing the interior of the drum to communicate with the exterior of the drum therethrough (e.g., the structures allowing the flow channel unit to communicate with the exterior of the cabinet therethrough), is openable with the smallest force.

In addition, the supply portion opening/closing device may be provided with a supply duct exhaust hole 71 provided to the supply duct 43 to allow the interior of a supply duct 43 to communicate with the interior of the cabinet 1 therethrough, and a supply duct door (a supply duct flap) 73 rotatably provided to the supply duct 41 to open the supply duct exhaust hole 71 when the pressure in the drum 2 is equal to or higher than the reference pressure.

In the case that the reference pressure is set to a pressure equal to or higher than the pressure to open the door 15, the self-weight of the supply duct door 73 may be equal to or lower than the force that fastens the door 15 and the cabinet 1 to each other. This is intended to cause the supply duct door 73 to be opened earlier than the door 15 when explosion occurs in the drum 2.

The supply duct door 73 may be arranged such that the supply duct exhaust hole 71 is closed by self-weight of the supply duct door 73. In other examples, the supply duct door 73 may be arranged such that the supply duct exhaust hole 71 is opened by a controlling device, such as a controller. However, closure based on self-weight may be used in addition or as an alternative to closure by a controller because electronic components equipped in the laundry treating apparatus 100 may malfunction when fire or explosion breaks out in the drum 2.

Further, the supply portion opening/closing device 71 and 73 may be provided at any location on the supply portion 4. For example, the supply portion opening/closing device 71 and 73 may be provided at the supply duct 43 adjacent to the supply portion connection hole 195. This location is intended to allow the air in the drum 2 to be discharged into the cabinet 1 when explosion occurs in the drum 2.

That is, the supply portion opening/closing device 71 and 73 may be provided on the surface of the duct body 431 facing the rear panel 13, or on the mount surface 435 provided at the upper portion of the duct body 431.

In the case that the supply portion opening/closing device 71 and 73 is provided on the surface of the duct body 431 facing the rear panel 13, a space is provided to prevent the rear panel 13 and the supply duct door 73 from interfering with each other when the supply duct door 73 is opened between the duct body 431 and the rear panel 13.

In addition, in the case that the supply portion opening/closing device 71 and 73 is provided on the surface of the duct body 431 facing the rear panel 13, the supply duct exhaust hole 71 may not be completely sealed solely by the self-weight of the supply duct door 73, and noise may be caused during operation of the laundry treating apparatus.

Therefore, the length of the laundry treating apparatus 100 in the depth direction (i.e., the X-axis direction) may be minimized and the supply portion opening/closing device 71 and 73 may be provided on the mount surface 435 to seal the supply duct exhaust hole 71.

As described above, the mount surface 435 may be arranged parallel with the bottom surface of the cabinet 1 or arranged inclined at a predetermined inclination angle from the supply portion connection hole 195 toward the bottom surface of the cabinet 1.

When the mount surface 435 is arranged inclined with respect to the bottom surface of the cabinet 1, rather than parallel with the bottom surface of the cabinet 1, the supply duct door 73 may be promptly opened and the supply duct exhaust hole 71 may be closed by self-weight of the supply duct door 73 when explosion occurs in the drum 2.

Hereinafter, a description will be given of the case in which the supply portion opening/closing device 71 and 73 is provided on the mount surface 435 arranged to be inclined.

As shown in FIG. 2, the supply duct exhaust hole 71 of the supply portion opening/closing device is arranged to penetrate the mount surface 435 to allow the interior of the duct body 431 to communicate with the interior of the cabinet 1 therethrough.

In this case, the supply duct door 73 may be provided with a body 731 (first body) to open and close the supply duct exhaust hole 71, a body support 733 (first body support) provided on the mount surface 435, and a rotating shaft 735 to couple the first body 731 to the first body support 733 such that the first body 731 is rotatable.

In the illustrated example of the laundry treating apparatus 100, when the air in the drum 2 is discharged from the cabinet 1 by the discharge portion 5, a negative pressure is formed in the drum 2, and thereby the air in the cabinet 1 is supplied to the drum 2 through the supply portion 4.

Accordingly, when the laundry treating apparatus 100 normally operates (e.g., when the exhaust fan 57 normally operates), a negative pressure is formed in the supply duct 43, and therefore the supply duct door 73 will not open the supply duct exhaust hole 71 so long as explosion does not occur in the drum 2 (e.g., so long as the pressure in the drum does not become equal to or higher than a reference pressure).

Figure 3:
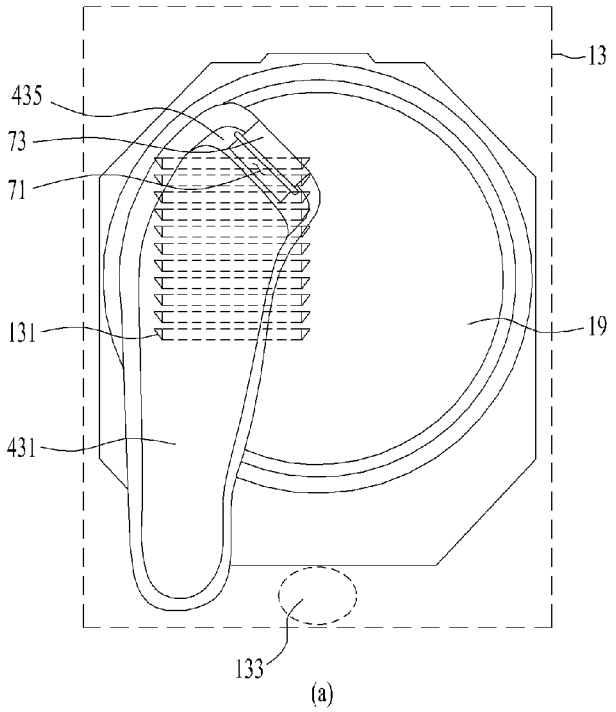
FIG. 3 is a view illustrating an example positional relationship between the pressure reduction portion and a cabinet discharge port provided to the rear panel of the cabinet.
Figure 3:
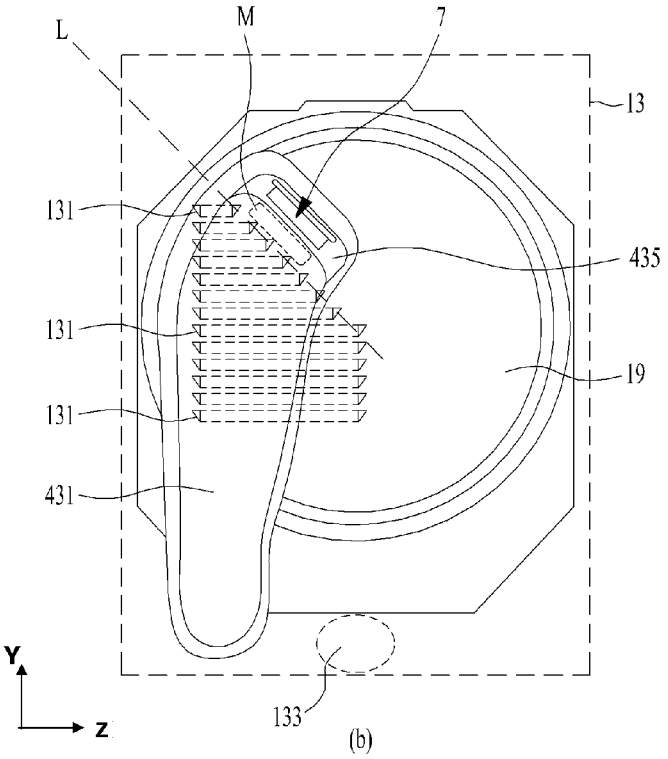

In the case that the cabinet inlet port 131 is provided to the rear panel 13 to supply air into the cabinet 1 as shown in FIG. 3(*a*), flames in the drum 2 may be discharged from the cabinet 1 in spite of the presence of the supply portion opening/closing device 71 and 73.

That is, in the case that the cabinet inlet port 131 is arranged in the width direction of the cabinet (the Z-axis direction) such that the cabinet inlet port 131 penetrates the projection plane M of the supply duct exhaust hole 71 projected on the rear panel 13, flames produced by explosion in the drum 2 may be disposed from the cabinet 1 via the supply duct exhaust hole 71 and the cabinet inlet port 131.

Accordingly, as shown in FIG. 3(*b*), the cabinet inlet port 131 may be arranged not to interfere with the projection plane M of the supply duct exhaust hole 71 projected on the rear panel 13.

The cabinet inlet port 131 may be provided to the rear panel 13 in an inclined manner L to be parallel with the lower portion of the projection plane M. In this case, however, it is possible that water outside of the cabinet is introduced into the cabinet through the cabinet inlet port 131.

Therefore, the cabinet inlet port 131 may be arranged on the rear panel 13 to be parallel with the bottom surface of the cabinet 1 but not to interfere with the projection plane M, as shown in FIG. 3(*b*).

In the illustrated example, the supply portion opening/closing device 71 and 73 is provided to the supply portion 4. This is simply an example, and the present disclosure is not limited thereto. The supply portion opening/closing device 71 and 73 may be provided at various locations so long as the air in the drum 2 is allowed to be discharged into the cabinet 1 when the pressure in the drum 2 is equal to or higher than the reference pressure.

That is, the supply portion opening/closing device 71 may be provided on the circumferential surface A (see FIG. 1) of the drum 2, or on at least one B of surfaces of the front support 17 and the rear support 19 (see FIG. 1).

The laundry treating apparatus 100 configured as described above may prevent flames in the drum 2 from being discharged from the cabinet 1 when pressure in the drum 2 becomes equal to or higher than the reference pressure due to explosion, as the supply duct door 73 opens the supply duct exhaust hole 71 before the door 15 opens the introduction port 111.

Figure 4:
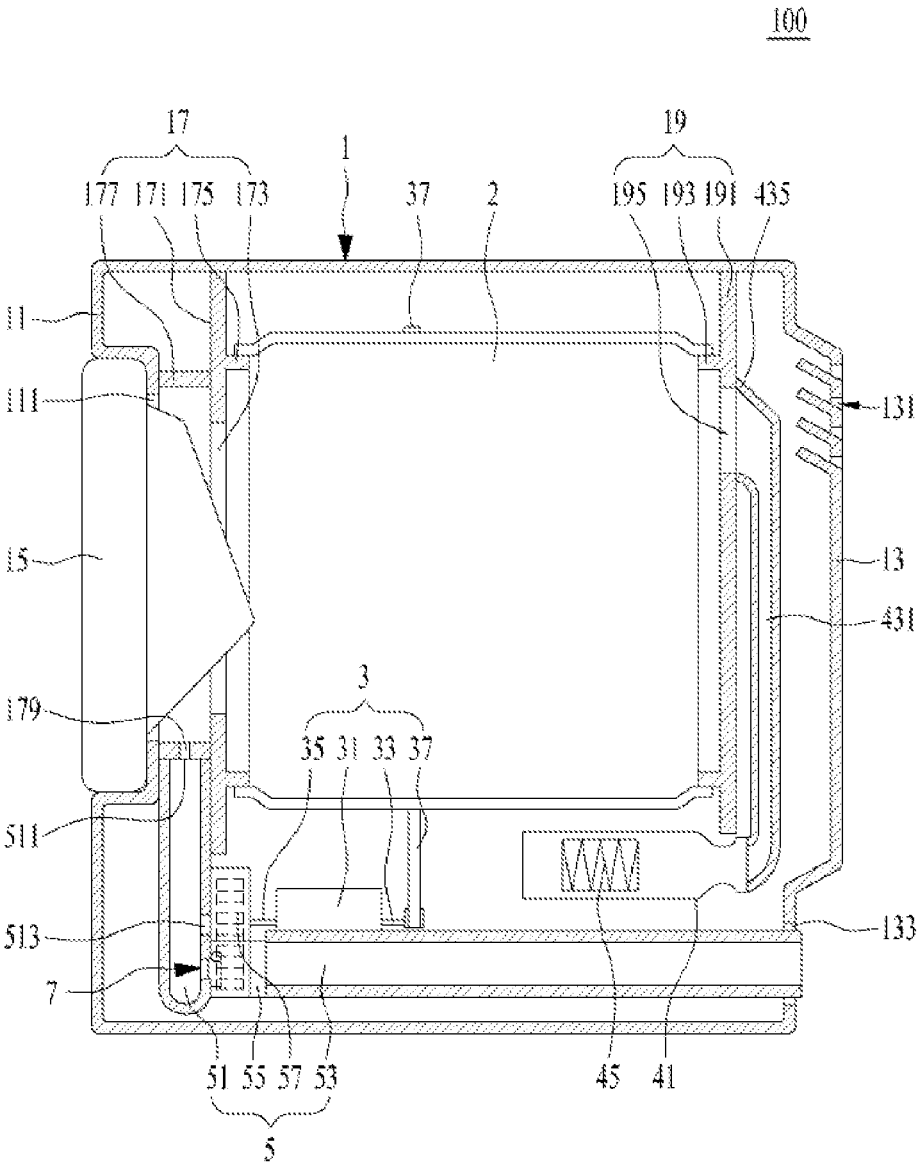
FIG. 4 is a view illustrating another example laundry treating apparatus.

FIG. 4 illustrates an example laundry treating apparatus 100. In this example, the pressure reduction portion 7 is provided with a discharge portion opening/closing device arranged at the discharge portion 5 to discharge the air in the drum into the cabinet 1 when the pressure in the drum is equal or higher than the reference pressure.

The discharge portion opening/closing device may be provided at any location at the discharge portion 5 so long as the air introduced from the drum 2 into the discharge portion 5 is supplied into the cabinet 1. For instance, the discharge portion opening/closing device may be provided to the connection duct 51, as shown in FIG. 5.

Among the parts of the discharge portion 5, the connection duct 51 is closest to the drum 2. Accordingly, in the case that the discharge portion opening/closing device 72 and 74 is provided to the connection duct 51, the pressure in the drum 2 may be quickly lowered when explosion occurs in the drum 2.

Figure 5:
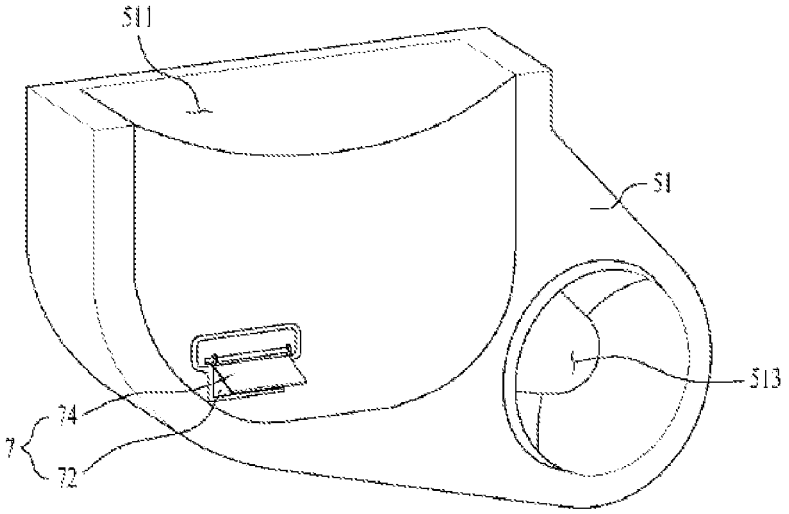
FIGS. 5 and 6 are views illustrating an example pressure reduction portion (e.g., an example discharge portion opening/closing device)
Figure 5:
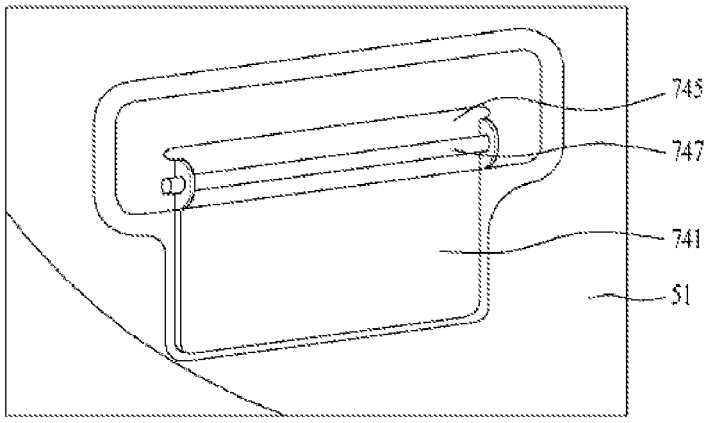

As shown in FIG. 5, the discharge portion opening/closing device may be provided with a connection duct exhaust hole 72 arranged to penetrate the connection duct 51, and a connection duct door (a connection duct flap) 74 rotatably arranged at the connection duct to open and close the connection duct exhaust hole 72.

The connection duct door 74 may be provided with a body 741 (second body) to close the connection duct exhaust hole 72 due to gravity, a second body support 745 fixed to the connection duct 51, and a rotating shaft 747 to connect the second body 741 with the second body support 745.

Similar to the self-weight of the supply duct door 73 (the self-weight of the first body 731), the self-weight of the connection duct door 74 (the self-weight of the second body) may be less than the force by which the door 15 and the cabinet 1 are fastened to each other.

Since the discharge portion opening/closing device 72 and 74 is positioned between the drum 2 and the exhaust fan 57, negative pressure is formed in the connection duct 51 when the air in the drum 2 is discharged by the exhaust fan 57. Accordingly, the connection duct door 74 does not open the connection duct exhaust hole 72, unless the pressure in the drum 2 becomes equal to or higher than a reference pressure.

Figure 6:
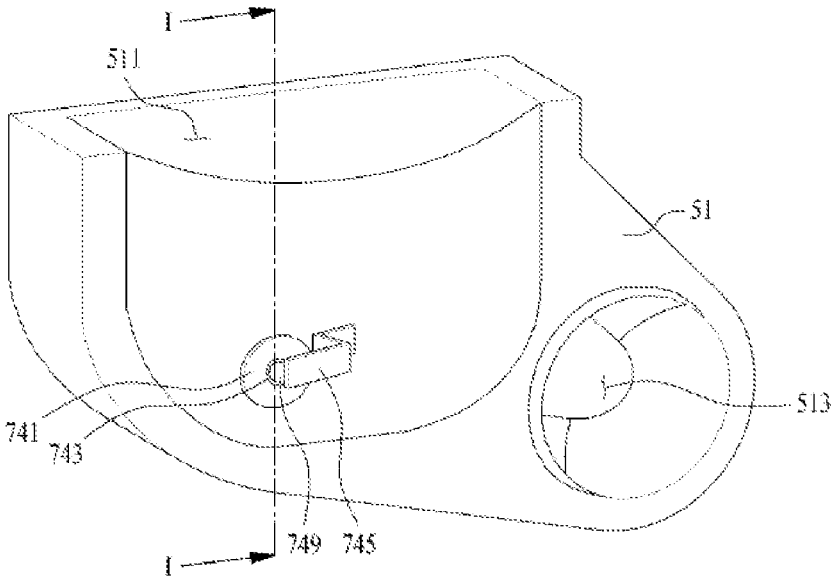
Figure 6:
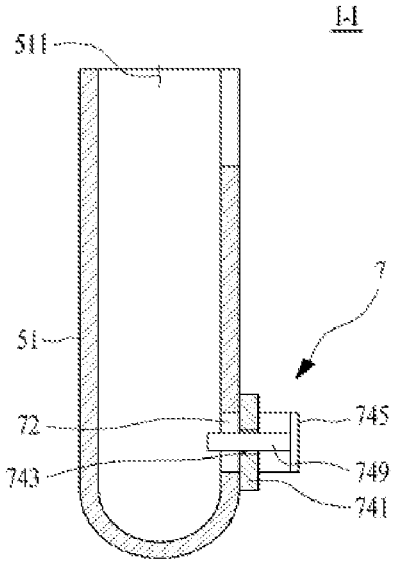

In some implementations, the discharge portion opening/closing device may be configured as shown in FIG. 6.

In this example, the discharge portion opening/closing device is configured such that a guider 749 provided to the second body support 745 guides movement of the second body 741.

To this end, the second body support 745 may be provided with a fixed end fixed to the connection duct 51, and an extended end extending from the fixed end toward the center of the second body 741 and spaced a predetermined distance from the second body 741.

In this case, a body penetrating hole 743 to penetrate the center of the second body 741 may be provided in the second body 741, and the guider 749 may extend from the extended end toward the connection duct exhaust hole 72 to be inserted into the body penetrating hole 743.

The discharge portion opening/closing device 72 and 74 shown in FIGS. 5 and 6 is adapted to lower the pressure in the drum 2, but it may not fulfill the purpose in the case that explosion occurs in the drum 2 with the laundry clogging the discharge portion connection hole 179 (e.g., with the duct inlet port 511 closed).

Therefore, the discharge portion opening/closing device 72 and 74 may be provided, along with the opening/closing device 71 and 73, to the supply portion 4.

Figure 7:
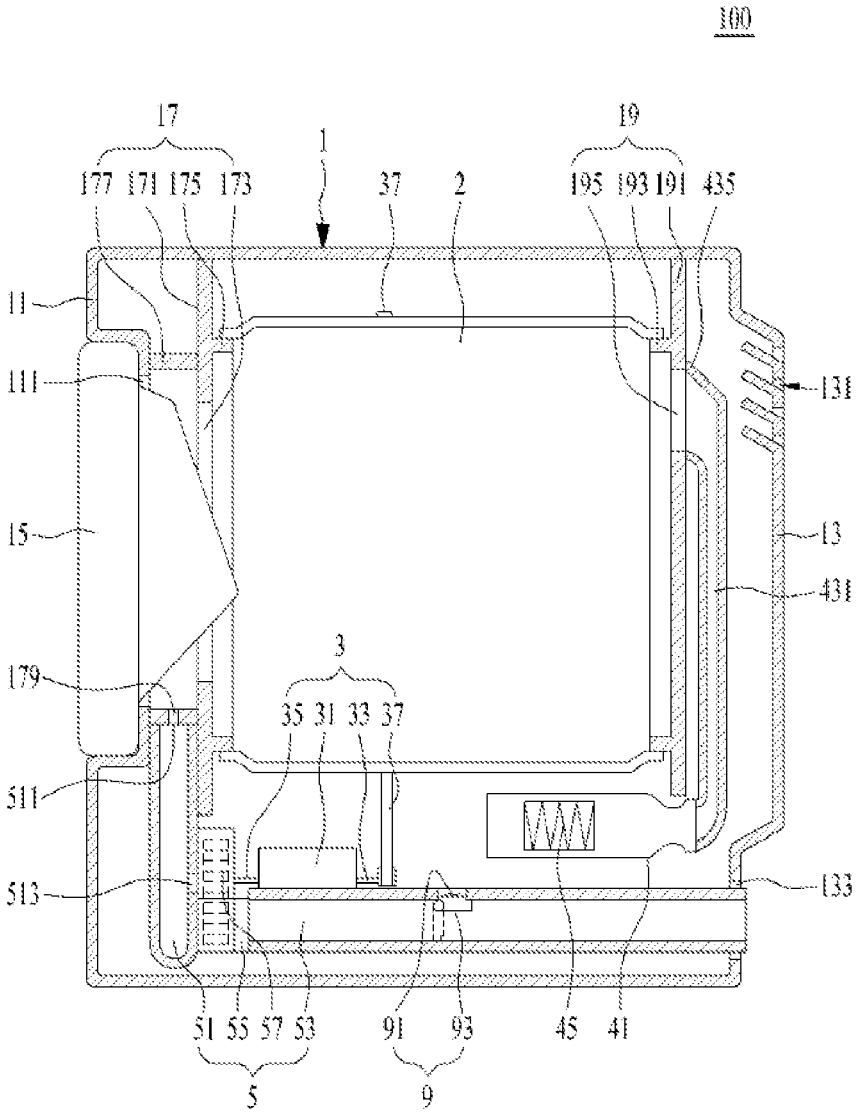
FIG. 7 is a view illustrating yet another example laundry treating apparatus.

In the example shown in FIG. 7, the shutoff portion 9 is provided to block supply of air into the drum 2 when fire breaks out in the drum 2 such that flames in the drum 2 are naturally extinguished.

That is, the shutoff portion 9 allows flow of air between the cabinet flow channel (defined by the cabinet inlet port 131) and the supply flow channels 41 and 43 when the exhaust fan 57 operates. The shutoff portion 9 blocks flow of air between the supply flow channels 41 and 43 and the cabinet flow channel 131, but allows flow of air between the discharge channels 51, 53 and 55 and the cabinet flow channel 131 when the exhaust fan 57 does not operate. Thereby, when fire breaks out in the drum 2, likelihood of explosion of the drum 2 may be reduced.

The shutoff portion 9 may be provided at any location in the laundry treating apparatus 100 so long as it is arranged in the down stream of the flow channel unit 2, 41, 43, 51 and 53 which guides the air having passed through the exhaust fan 57 to the outside of the cabinet 1. FIG. 7 shows an example of the shutoff portion 9 provided at the discharge portion 5.

Figure 8:
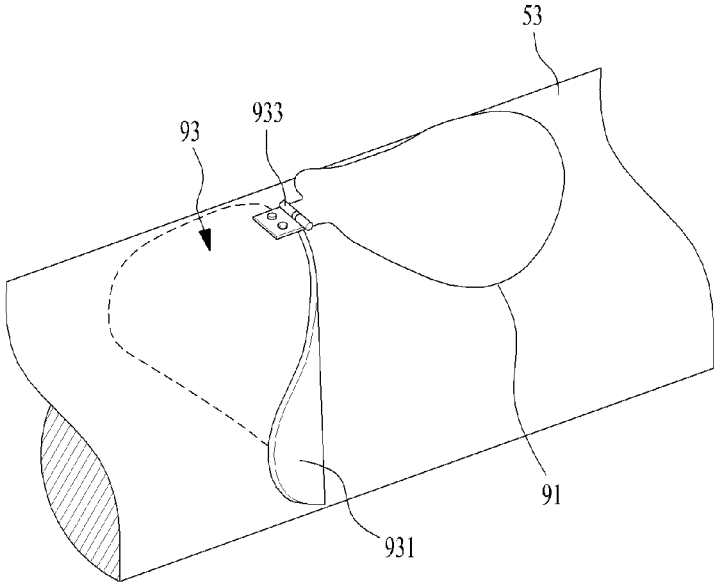
FIG. 8 is a view illustrating an example shutoff portion (e.g., an example explosion prevention portion) provided to a laundry treating apparatus.
Figure 8:
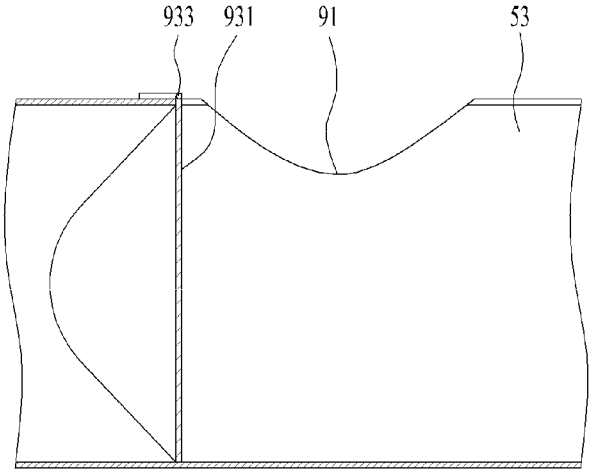

As shown in FIG. 8, the shutoff portion 9 may be provided with an exhaust duct penetrating hole 91 arranged to penetrate the exhaust duct 53 to allow the interior of the exhaust duct 53 to communicate with the interior of the cabinet 1, and a penetrating hole door (a penetrating hole flap) 93 rotatably provided to the exhaust duct 53 to selectively open the exhaust duct penetrating hole 91 and the exhaust duct 53 (e.g., to open one of the exhaust duct penetrating hole and the exhaust duct).

The penetrating hole door 93 may be provided with a body rotation shaft 933 provided to the exhaust duct 53, and a body 931 to selectively open the exhaust duct penetrating hole 91 and the exhaust duct 53 by rotating about the body rotation shaft 933 in the exhaust duct 53.

The body 931 may be configured such that the exhaust duct penetrating hole 91 is opened and closed by a controller. Also, the body 931 may be configured such that the exhaust duct 53 is closed by the self-weight of the body 931 and the exhaust duct penetrating hole 91 is closed by the exhaust fan 57.

This configuration is intended to enable the shutoff portion 9 to operate in the case that electronic devices malfunction due to fire breaking out in the drum 2.

In the illustrated example of the laundry treating apparatus 100, when the air in the drum 2 is discharged from the cabinet 1 by the exhaust fan 57, a negative pressure is formed in the drum 2, and thereby the air in the cabinet 1 is supplied to the drum 2 through the supply portion 4. Accordingly, when the exhaust fan 57 does not operate, little air is supplied into the drum 2.

However, since the exhaust duct 53 provided to the laundry treating apparatus 100 is exposed to the outside of the cabinet 1, air may be supplied into the drum 2 depending on change in atmospheric pressure outside of the laundry treating apparatus 100 even when the exhaust fan 57 does not operate.

That is, in the case of a typical laundry treating apparatus 100, the exhaust duct 53 is connected to a flow channel arranged through the wall of the house to discharge air discharged from the drum 2 to the outdoors during drying of the laundry. Therefore, depending on a change in the outdoor atmospheric pressure, the outdoor air may be supplied into the drum 2 through the exhaust duct 53, or the air in the drum 2 may be discharged to the outdoor through the exhaust duct 5.

This is the same as the case in which the laundry treating apparatus 100 is installed indoors. Depending on change in the indoor atmospheric pressure, air may be supplied into the drum 2 through the exhaust duct 53, or air may be discharged from the drum 2.

In short, simply stopping the exhaust fan 57 when fire breaks out in the drum 2 may not block supply of air into the drum 2.

The shutoff portion 9 is intended to prevent explosion in the drum 2 due to supply of air into the drum 2 when operation of the exhaust fan 57 has been stopped.

Suppose that operation of the exhaust fan 57 has been stopped due to occurrence of explosion in the drum 2 and the atmospheric pressure outside of the laundry treating apparatus 100 is lower.

As shown in FIG. 7, when operation of the exhaust fan 57 is stopped, the exhaust duct penetrating hole 91 is opened and the exhaust duct 53 is closed by the penetrating hole door 93. Accordingly, the air in the drum 2 is not discharged from the cabinet 1 through the exhaust duct 53 even if the atmospheric pressure outside of the cabinet 1 is low.

If the air in the drum 2 is not discharged from the cabinet 1, the air in the cabinet 1 will not be supplied to the drum 2 through the supply portion 4 (flow of air between the supply flow channels 41 and 43 and the cabinet flow channel 131 will be blocked). Therefore, flames in the drum 2 will be extinguished when all of the oxygen in the drum 2 is consumed.

Also, the air in the cabinet 1 will be discharged from the cabinet 1 through the exhaust duct penetrating hole 91 since the atmospheric pressure outside of the cabinet 1 is low (e.g., flow of air between the discharge flow channels 51, 53 and 55 and the cabinet flow channel 131 occurs).

When the air in the cabinet is discharged from the cabinet 1 through the exhaust duct penetrating hole 91, the air in the drum 2 is allowed to be discharged from the cabinet 1 through the supply portion 4. Therefore, the shutoff portion 9 may quickly extinguish the flames in the drum 2 when the atmospheric pressure outside of the cabinet 1 is low.

Next, suppose that operation of the exhaust fan 57 has been stopped due to occurrence of explosion in the drum 2 and the atmospheric pressure outside of the laundry treating apparatus 100 is high.

Since operation of the exhaust fan 57 has been stopped, the exhaust duct penetrating hole 91 is opened and the exhaust duct 53 is closed by the penetrating hole door 93. Accordingly, the air outside of the cabinet 1 is not supplied into the drum 2 through the exhaust duct 53 even if the atmospheric pressure outside of the cabinet 1 is high.

However, the air outside of the cabinet 1 may be introduced into the cabinet 1 through the exhaust duct 53 and the exhaust duct penetrating hole 91 since the atmospheric pressure outside of the cabinet 1 is high.

Through experimentation, however, even if the air outside of the cabinet 1 is introduced into the cabinet 1 through the exhaust duct penetrating hole 91 due to high atmospheric pressure outside of the cabinet 1, it is rarely possible that the air is supplied to the drum 2 through the supply portion 4.

This may be because the pressure in the drum 2 has been increased along with the increase of the amount of gas due to fire breaking out in the drum 2, although the amount of air in the drum 2 is reduced due to fire.

Therefore, the shutoff portion 9 may cause the flames in the drum 2 to be naturally extinguished by shutting off air supplied into the drum 2, even when the atmospheric pressure outside of the laundry treating apparatus 100 is high.

Figure 9:
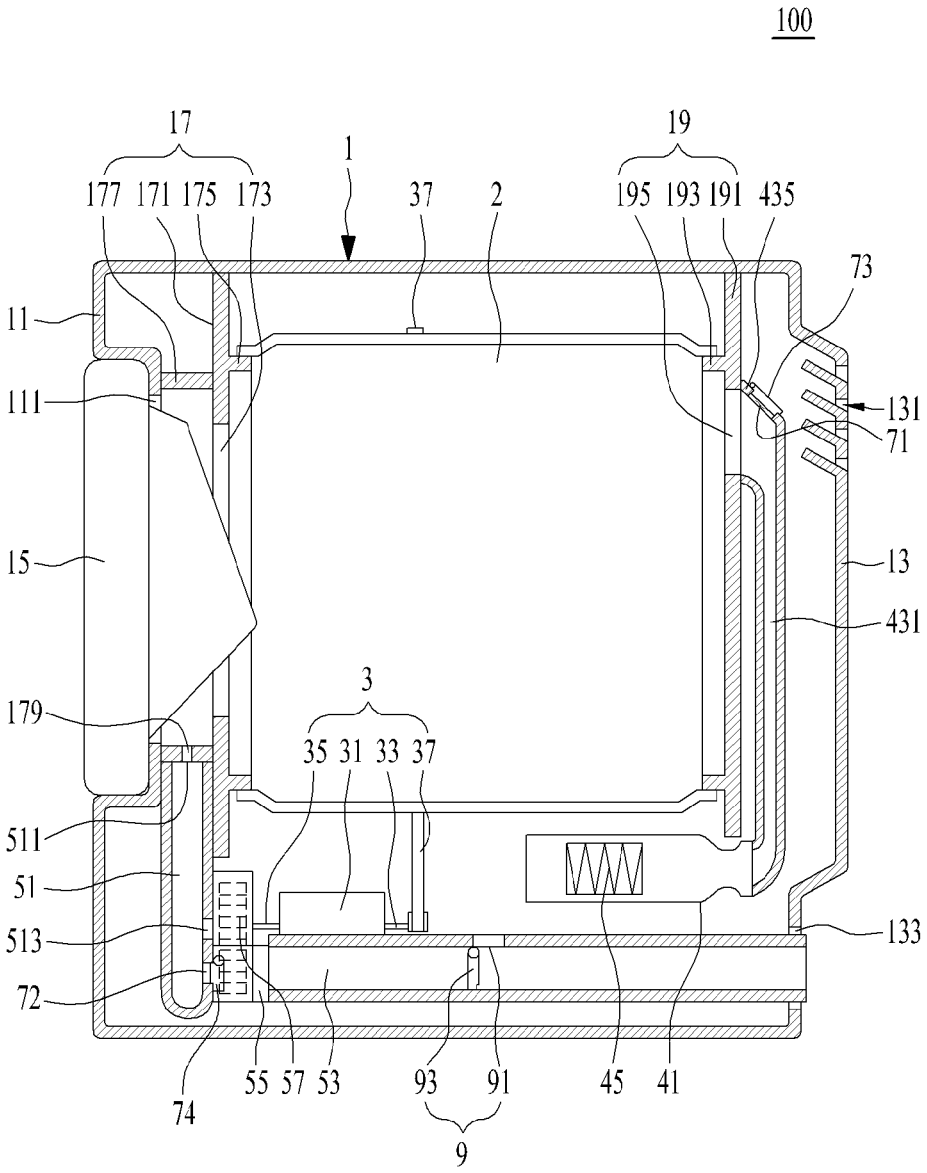
FIG. 9 is a view illustrating an example of the laundry treating apparatus provided with both the pressure reduction portion and the shutoff portion.

FIG. 9 illustrates an example laundry treating apparatus 100 provided with both the pressure reduction portion 7 and the shutoff portion 9.

In this example, the pressure reduction portion 7 is provided with an opening/closing device 71 and 73 (a supply portion opening/closing device) provided to the supply portion 4 and a discharge portion opening/closing device 72 and 74 provided to the discharge portion 5. The opening/closing device 71 and 73 and discharge portion opening/closing device 72 and 74 are adapted to discharge the air in the drum 2 into the cabinet 1 when the pressure in the drum 2 is equal to or higher than a reference pressure. The shutoff portion 9 is provided to the exhaust duct 53 to open the exhaust duct penetrating hole 91 and close the exhaust duct 53 when operation of the exhaust fan 57 is stopped.

The structures and effects of the opening/closing device 71 and 73, the discharge portion opening/closing device 72 and 74, and the shutoff portion 9 are the same as those described in the previous examples, and, thus, a detailed description thereof will be referenced, rather than repeated.

A laundry treating apparatus according to the present disclosure may allow flames in the accommodation space containing laundry to be naturally extinguished when fire breaks out in the accommodation space.

A laundry treating apparatus also may prevent explosion from occurring in the accommodation space containing laundry due to flammable gas when fire breaks out in the accommodation space.

Further, a laundry treating apparatus may prevent flames from being discharged from the accommodation space containing laundry when explosion occurs in the accommodation space.

It will be apparent to those skilled in the art that various modifications and variations can be made without departing from the spirit or scope of the disclosure. Thus, the present disclosure is intended to cover modifications and variations that come within the scope of the appended claims and their equivalents.

What is claimed is:

1. A laundry treating apparatus comprising:

a cabinet;

an accommodation space provided in the cabinet and configured to receive laundry;

a discharge portion configured to allow an interior of the accommodation space to communicate with an exterior of the cabinet, and adapted to discharge air in the accommodation space from the cabinet;

a supply portion that supplies air into the accommodation space based on the air in the accommodation space being discharged through the discharge portion; and a shutoff portion positioned in the cabinet and adapted to open and close the discharge portion, wherein, in a closed configuration, the shutoff portion prevents the air in the accommodation space from being discharged from the cabinet through the discharge portion and allows air in the cabinet, but outside of the accommodation space, to discharge from the cabinet through the discharge portion.

2. The laundry treating apparatus according to claim 1, wherein:

the discharge portion comprises a connection duct that allows the air in the accommodation space to be discharged through the discharge portion, and an exhaust duct that guides air introduced into the connection duct to the exterior of the cabinet; and the shutoff portion comprises:

an exhaust duct penetrating hole provided to the exhaust duct to allow an interior of the exhaust duct to communicate with an interior of the cabinet; and a penetrating hole flap provided to the exhaust duct and configured to open one of the exhaust duct penetrating hole and the exhaust duct.

3. The laundry treating apparatus according to claim 2, wherein the discharge portion further comprises an exhaust fan configured to introduce the air in the accommodation space into the connection duct, wherein the penetrating hole flap closes the exhaust duct penetrating hole based on the exhaust fan operating, and closes the exhaust duct based on operation of the exhaust fan having stopped.

4. The laundry treating apparatus according to claim 1, wherein the shutoff portion allows the discharge portion to communicate with an interior of the cabinet that is outside of the accommodation space based on the shutoff being arranged in a closed configuration in which the discharge portion is closed.

5. The laundry treating apparatus according to claim 1, further comprising a pressure reduction portion positioned in the cabinet and configured to discharge the air in the accommodation space from the accommodation space to the cabinet based on a pressure in the accommodation space becoming equal to or higher than a predetermined reference pressure.

6. The laundry treating apparatus according to claim 5, wherein the pressure reduction portion comprises an opening and closing device provided to at least one of the accommodation space and the supply portion and configured to open and allow the air in the accommodation space to flow into the cabinet based on the pressure in the accommodation space becoming equal to or higher than a predetermined reference pressure.

7. The laundry treating apparatus according to claim 6, wherein the supply portion comprises a heating duct configured to heat the air in the cabinet and a supply duct configured to guide air discharged from the heating duct to the accommodation space, wherein the opening and closing device comprises:

a supply duct exhaust hole provided to penetrate the supply duct and allow an interior of the supply duct to communicate with the interior of the cabinet; and a supply duct flap provided to the supply duct and configured to close the supply duct exhaust hole.

8. The laundry treating apparatus according to claim 7, wherein the supply duct flap is rotatably provided to the supply duct and configured to close the supply duct exhaust hole based on a self-weight of the supply duct flap.

9. The laundry treating apparatus according to claim 8, wherein the cabinet further comprises an introduction port communicating with the accommodation space and a door provided to open and close the introduction port, wherein a pressure in the accommodation space needed to overcome the self-weight of the supply duct flap and open the supply duct flap is less than a pressure in the accommodation space needed to overcome a force by which the door is fastened to the cabinet and open the door.

10. The laundry treating apparatus according to claim 7, further comprising a rear support provided in the cabinet and supporting a rear surface of the accommodation space, the rear support being provided with a supply portion communication hole connected to the supply duct, wherein the supply duct comprises a duct body extending from the heating duct toward the supply portion communication hole along a direction of a height of the cabinet, and an inclined surface to connect the duct body with the supply portion communication hole, the inclined surface being arranged to be inclined toward a bottom surface of the cabinet, wherein the opening and closing device is provided on the inclined surface.

11. The laundry treating apparatus according to claim 6, further comprising:

a front support provided in the cabinet and supporting a front surface of the accommodation space, the front support being provided with a discharge portion communication hole that allows the air in the accommodation space to be discharged to the discharge portion; and a rear support provided in the cabinet and supporting a rear surface of the accommodation space, the rear support being provided with a supply portion communication hole connected to the supply portion, wherein the opening and closing device is provided to at least one of the front support and the rear support.

12. The laundry treating apparatus according to claim 6, wherein the pressure reduction portion comprises a discharge portion opening/closing device provided to the discharge portion and configured to open and allow the air in the accommodation space to flow into the cabinet based on the pressure in the accommodation space becoming equal to or higher than the reference pressure.

13. The laundry treating apparatus according to claim 12, wherein the discharge portion comprises a connection duct that allows the air in the accommodation space to be discharged through the discharge portion, an exhaust fan configured to move the air in the accommodation space into the connection duct, and an exhaust duct configured to discharge air introduced into the connection duct from the cabinet, wherein the discharge portion opening/closing device is provided to the connection duct.

14. The laundry treating apparatus according to claim 13, wherein the discharge portion opening/closing device comprises:

a connection duct exhaust hole that allows an interior of the connection duct to communicate with an interior of the cabinet through the connection duct exhaust hole; and a connection duct flap configured to open and close the connection duct exhaust hole.

15. The laundry treating apparatus according to claim 14, wherein:

the connection duct exhaust hole is positioned between an introduction port of the connection duct and the exhaust fan; and the connection duct flap is rotatably provided to the connection duct and configured to close the connection duct exhaust hole based on a self-weight of the connection duct flap.

16. The laundry treating apparatus according to claim 14, wherein:

the connection duct exhaust hole is positioned between an introduction port of the connection duct and the exhaust fan; and the connection duct flap comprises:

a body configured to open and close the connection duct exhaust hole;

a body support provided to the connection duct and spaced a predetermined distance from the body; and a guider adapted to penetrate the body and extend from the body support toward the connection duct exhaust hole.

17. A laundry treating apparatus comprising:

a cabinet;

an accommodation space provided in the cabinet and configured to receive laundry;

a cabinet flow channel configured to allow an interior of the cabinet to communicate with an exterior of the cabinet through the cabinet flow channel;

an accommodation space flow channel that connects the accommodation space, a discharge flow channel that guides air in the accommodation space to the exterior of the cabinet, and a supply flow channel that guides air into the accommodation space;

a fan provided to the accommodation space flow channel and configured to discharge the air in the accommodation space from the cabinet; and a shutoff portion that is configured to allow flow of air between the cabinet flow channel and the supply flow channel based on the fan operating and that is configured to, based on operation of the fan having stopped, prevent the flow of air between the supply flow channel and the cabinet flow channel while allowing flow of air between the discharge flow channel and the cabinet flow channel.

18. The laundry treating apparatus according to claim 17, wherein the shutoff portion is provided in a down stream portion of the accommodation space flow channel at a location guiding air having passed through the fan toward the exterior of the cabinet.

19. The laundry treating apparatus according to claim 18, further comprising a pressure reduction portion provided in an upper stream portion of the accommodation space flow channel at a location guiding air to the fan, the pressure reduction portion being configured to discharge the air in the accommodation space into the cabinet based on a pressure in the accommodation space becoming equal to or higher than a predetermined reference pressure.

20. The laundry treating apparatus according to claim 19, wherein the cabinet further comprises an introduction port communicating with the accommodation space and a door provided to the cabinet and configured to open and close the introduction port, wherein the pressure reduction portion allows the accommodation space flow channel to communicate with the interior of the cabinet based on a pressure in the accommodation space that is less than a pressure in the accommodation space needed to overcome a force by which the door is fastened to the cabinet and open the door.

21. The laundry treating apparatus according to claim 20, wherein the cabinet flow channel is defined by a cabinet flow inlet provided to penetrate the cabinet, wherein the cabinet flow inlet does not overlap a projection of the pressure reduction portion onto the cabinet such that air discharged from the pressure reduction portion does not discharge from the cabinet through the cabinet flow inlet.

* * * * *